United States Patent [19]

Hafner et al.

[11] Patent Number: 5,067,181

[45] Date of Patent: Nov. 26, 1991

[54] BLOW OUT TOILET WITH LOW WATER VOLUME USAGE

[75] Inventors: V. Walter Hafner; Keith D. Marshall, both of Whittier, Calif.

[73] Assignee: Acorn Engineering Company, Los Angeles, Calif.

[21] Appl. No.: 492,953

[22] Filed: Mar. 13, 1990

[51] Int. Cl.[5] ..... E03D 11/18

[52] U.S. Cl. ..... 4/425; 4/430

[58] Field of Search ..... 4/422, 423, 424, 425, 4/428, 430, DIG. 15, 420, 421

[56] References Cited

U.S. PATENT DOCUMENTS

| | | | |
|---|---|---|---|
| 1,253,506 | 1/1918 | Madden | 4/425 |
| 1,928,717 | 10/1933 | Campus | 4/422 |
| 1,973,349 | 9/1934 | Kruse | 4/425 |
| 1,998,861 | 4/1935 | Campus | 4/422 |
| 2,202,628 | 5/1940 | Groeniger | 4/425 |
| 3,656,499 | 4/1972 | Nelson et al. | 251/120 |
| 3,843,978 | 10/1974 | Ragot | 4/425 |
| 4,498,203 | 2/1985 | Barnum et al. | 4/DIG. 15 |
| 4,538,307 | 9/1985 | Barnum et al. | 4/DIG. 15 |

*Primary Examiner*—Henry J. Recla
*Assistant Examiner*—Robert M. Fetsuga
*Attorney, Agent, or Firm*—Edgar W. Averill, Jr.

[57] ABSTRACT

An improved blow out toilet having remarkably low water volume usage. The toilet is of the type having a toilet bowl including a rinse ring having a rinse water nozzle directing water therein and a trap including a flush water nozzle. The improvement includes the reshaping of the toilet bowl and the reduction in size and reshaping of both the rinse water orifice and the flush water orifice.

8 Claims, 3 Drawing Sheets

FIG. 8.
PRIOR ART
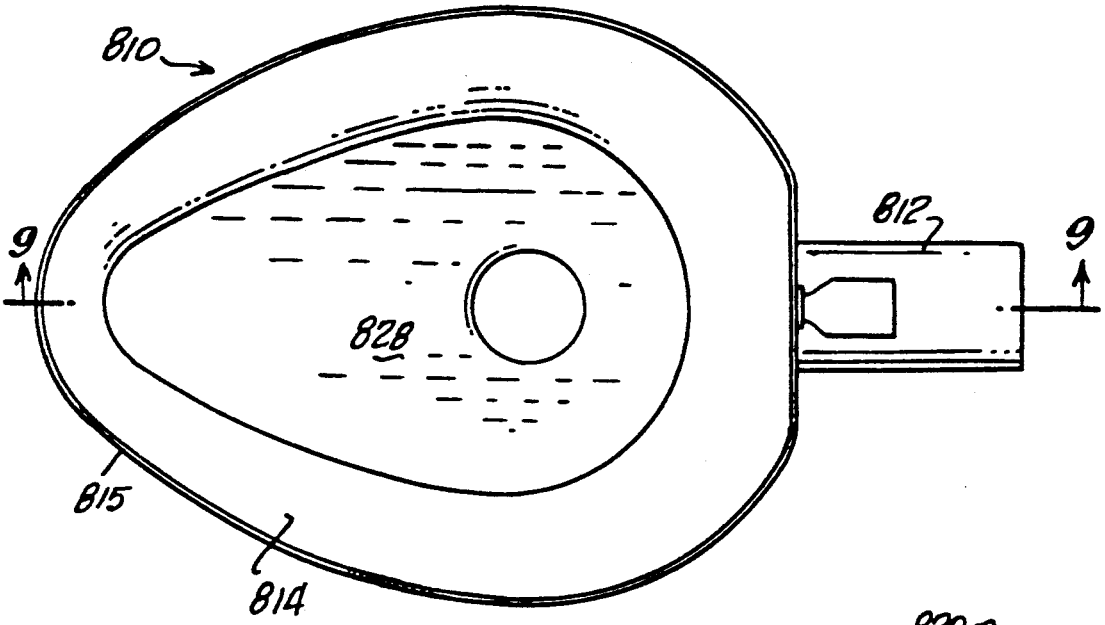
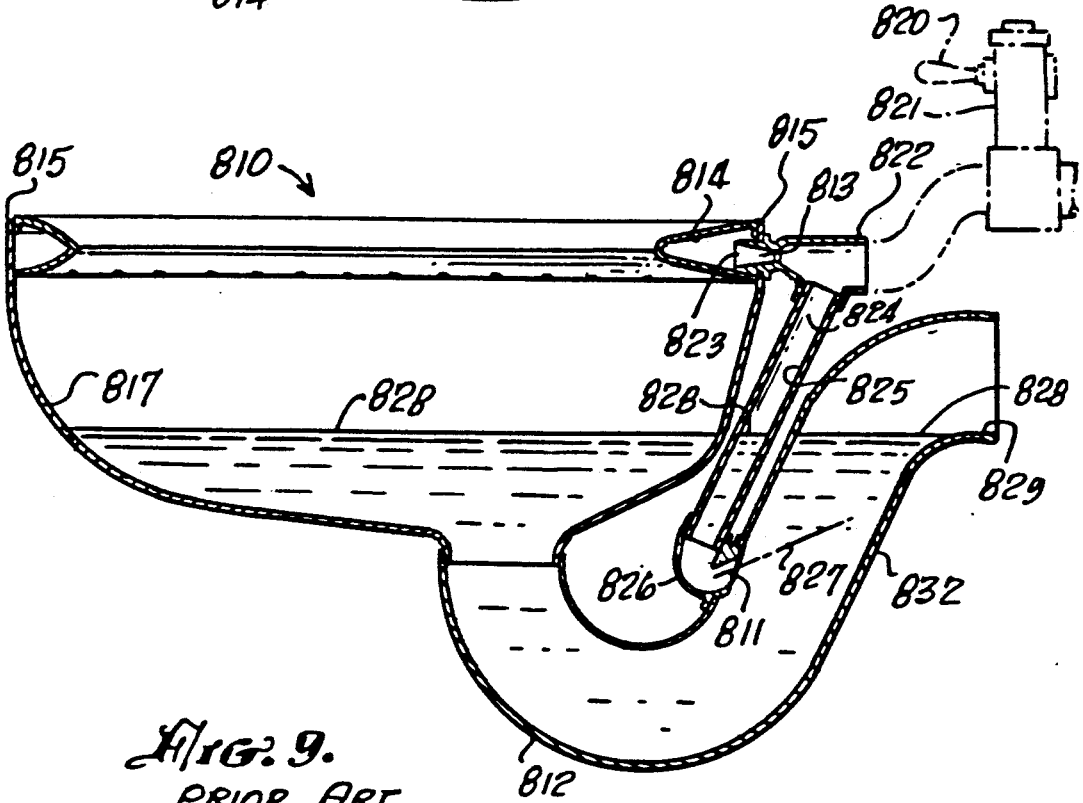
FIG. 9.
PRIOR ART

BLOW OUT TOILET WITH LOW WATER VOLUME USAGE

BACKGROUND OF THE INVENTION

The field of the invention is plumbing fixtures, and the invention relates more particularly to toilet fixtures of the type generally referred to as "blow out" toilets.

The standard residential toilet includes a water storage tank. When the toilet is flushed, the water flows by gravity from the tank and into the toilet bowl. The blow out fixture, in contrast, does not utilize a water tank and, instead, the flush valve (flushometer) feeds water under pressure into the trap below the toilet (as well as feeding rinse water into the toilet bowl). Blow out fixtures are more commonly used in institutional applications and are relatively maintenance free as well as being relatively vandal proof.

There has been a trend toward water conservation, and some municipalities are requiring toilet fixtures which consume less water per flush than conventional toilets. The conventional tank type of toilet typically uses between 3½ and 5 gallons per flush, and designs have been developed which reduce the volume of water usage to consistently below 1.6 gallons. Very low water usage toilets have been designed for specific purposes such as on commercial passenger aircraft. Such reduction has not been made, however, in the blow out style of toilet with flush valve, and it was not believed possible to provide a reliable toilet design that would approach the low volume usage of 1.6 gallons or less per flush. Such low volume usage must be provided even when there is less than optimum water pressure since institutional water pressures can be found to be as low as 32 pounds per square inch static (25 pounds per square inch flow pressure).

SUMMARY OF THE INVENTION

It is an object of the present invention to provide a blow out style toilet which is capable of consistently using less than 1.6 gallons per flush at a water pressure as low as 25 pounds per square inch flow pressure.

The present invention is an improved blow out toilet of the type having a toilet bowl and a trap affixed to the base of the bowl and leading downwardly, then curving upwardly to a straight portion at an angle of about 45° and then curving to about a horizontal orientation. The trap permits water to fill the bowl to a predetermined level. The blow out toilet also includes a rinse water outlet ring near the top of the interior of the bowl, a rinse water nozzle including an orifice with its outlet directed into the rinse water outlet ring and a flush water nozzle which includes an orifice positioned in the trap below the predetermined water level and aimed rearwardly therein. A flush valve and piping provide a predetermined volume of water simultaneously to said nozzles when opened.

A shallow angled toilet bowl base is smoothly shaped so that no more than about 0.66 gallon of water is held in the bowl while providing an area of water coverage at least 10"×12". A generally oval and frusto-conically shaped ring at the base of the shallow angled toilet bowl provides a transition between the bowl and the trap. In a preferred embodiment, the upper edge of this ring is formed at an angle from the horizontal. The bowl includes a rinse water nozzle orifice between 0.21 and 0.26 inch in diameter and a flush water nozzle orifice between 0.21 and 0.26 inch in diameter. The flush water orifice is mounted in the top of the straight portion of the trap at the beginning of the straight portion thereof.

BRIEF DESCRIPTION OF THE DRAWINGS

FIG. 8 is a plan view of a prior art toilet fixture.

FIG. 9 is a cross-sectional view taken along line 9—9 of FIG. 8.

DESCRIPTION OF THE PREFERRED EMBODIMENTS

Figure 1:
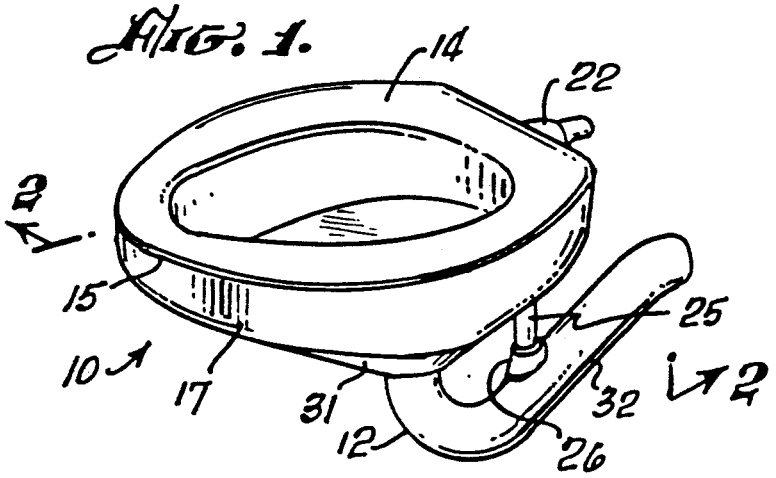
FIG. 1 is a perspective view of the toilet fixture of the present invention.
Figure 2:
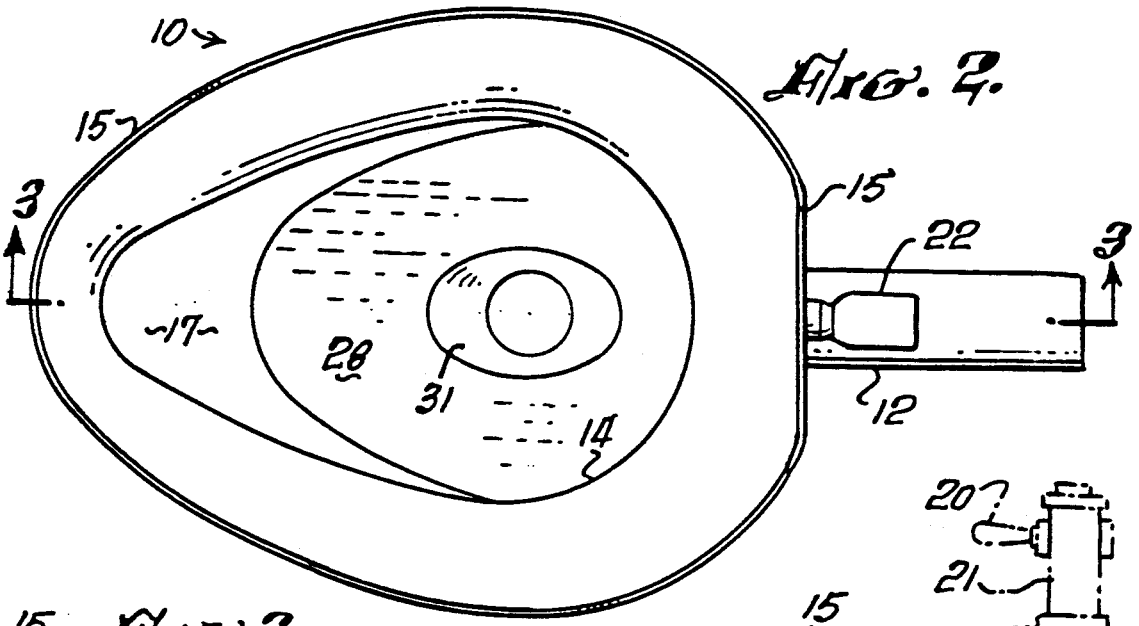
FIG. 2 is a plan view thereof.
Figure 3:
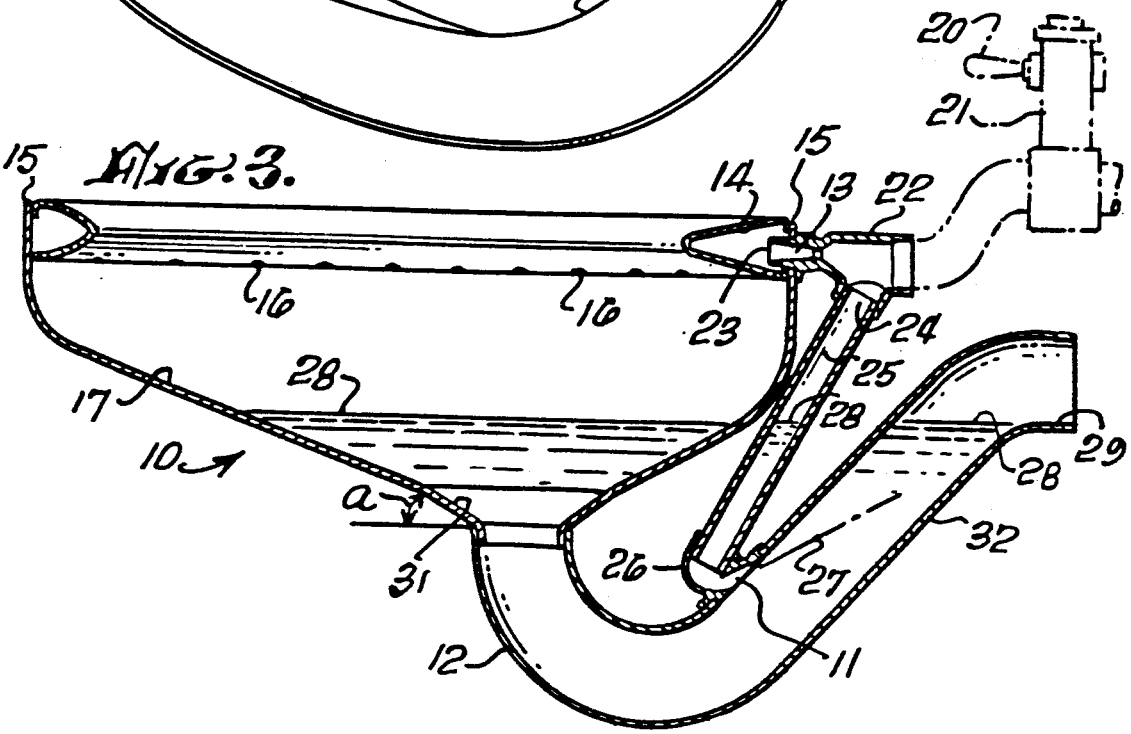
FIG. 3 is a cross-sectional view taken along line 3—3 of FIG. 2.

The improved toilet fixture of the present invention is shown in FIG. 1 in perspective view, in FIG. 2 in plan view and in FIG. 3 in cross-sectional view and indicated by reference character 10. Fixture 10 is of the blow out style and, instead of using a tank or reservoir, passes water rearwardly and upwardly through a flush water nozzle 11 in trap 12. This flow of water through nozzle 11 creates a vacuum and starts evacuating most material in the bowl. A rinse water nozzle 13 simultaneously feeds water into a rinse water outlet ring 14 which surrounds the entire rim 15 of the toilet. Rinse water outlet ring 14 has a plurality of rinse water outlet openings 16 which direct water downwardly along the interior of bowl 17 to wash down the walls of the toilet bowl.

A prior art toilet fixture is shown in FIGS. 8 and 9 and has the same elements, although there are important differences between the two as will be pointed out further below. The elements have been indicated by the same reference characters to which 800 has been added. The fixtures of FIGS. 1, 2, 3, 8 and 9 are fabricated from stainless steel and may be used in areas of very high vandalism such as prisons, mental institutions and parks. The design of the present invention, however, is not limited to such stainless steel fixtures and is applicable to ceramic blow out fixtures as well.

The water usage of the prior art fixture shown in FIGS. 8 and 9 is normally between 3½ and 5 gallons per flush. The flush is initiated by pushing a pushbutton or moving a lever 20 or 820 on a flush valve 21 or 821 which feeds a predetermined volume of water to the fixture. The water is fed through a generally T-shaped fitting 22 which has the rinse water nozzle 13 near outlet 23 and a flush water outlet 24. The water then passes through flush water line 25 into the flush water nozzle fitting 26 which includes the flush water nozzle 11 which directs the water rearwardly and upwardly in the direction of line 27.

The water level in the unit is indicated by reference character 28 and is determined by the base of the trap unit at reference character 29.

Turning again to the prior art fixture 810, the fixture was equipped with a rinse water nozzle orifice having a diameter of 0.425 inch and a flush water nozzle orifice having a diameter of 0.343 inch. It was initially found that by reducing the diameter of either or both of these nozzles that the unit would not flush properly. After experimentation, however, it was discovered that by changing the shape of the bottom of the toilet bowl, by providing a smooth transition between the bowl and the trap and by reducing and balancing the sizes of the rinse water nozzle orifice and the flush nozzle orifice that a flush volume of below 1.6 gallons could consistently be obtained. This low flush volume was still possible when a flow pressure of 25 pounds per square inch (which is equivalent to a static water pressure of about 32 pounds per square inch for most installations) was used.

More specifically, it was discovered that the water volume in the toilet bowl above trap 12 had to be reduced to no more than about 0.66 gallon of water. This is preferably accomplished by providing a shallow, generally conically shaped bottom having an angle of between about 20° and 35° between water level 28 and the inner surface of the base of the bowl. Furthermore, the providing of a generally frusto-conical outlet ring 31 having about a 25° to 45° angle substantially improved the operation of the fixture. This angle is indicted by reference character "a" in FIG. 3. This generally frusto-conical ring should preferably extend away from the trap 12 at least about one inch at at least one point. Most importantly, however, it was found that the relative size and actual size of the orifices in the rinse water and flush water nozzles is critical. It is believed that the diameter of the rinse water nozzle can vary between about 0.21 and 0.26 inches, and the two nozzles should be approximately the same size. It is also important that the flush water nozzle be located near the base of the straight portion 32 of trap 12 and, preferably, on the top thereof aimed generally rearwardly and upwardly as shown at reference character 27.

Several tests have been developed to test the efficacy of the flushing action. One such test involves placing 2,500 floating plastic granules in the toilet bowl. To pass the test, no more than 125 granules can be left in the bowl. Another test uses 100 floating balls, and in this test no more than 25 balls can be left in the bowl. This latter test is described in ASME/ANSI tentative tests for the Hydraulic Performance for Water Closets and Urinals, Draft dated April 1989, test number A112.19.6, Draft #10, paragraph 6.1.8.1. et seq.

The design described above, and shown in FIGS. 1, 2 and 3, consistently passed this test with water pressures as low as 32 pounds per square inch static and 25 pounds per square inch flow pressure.

Figure 4:
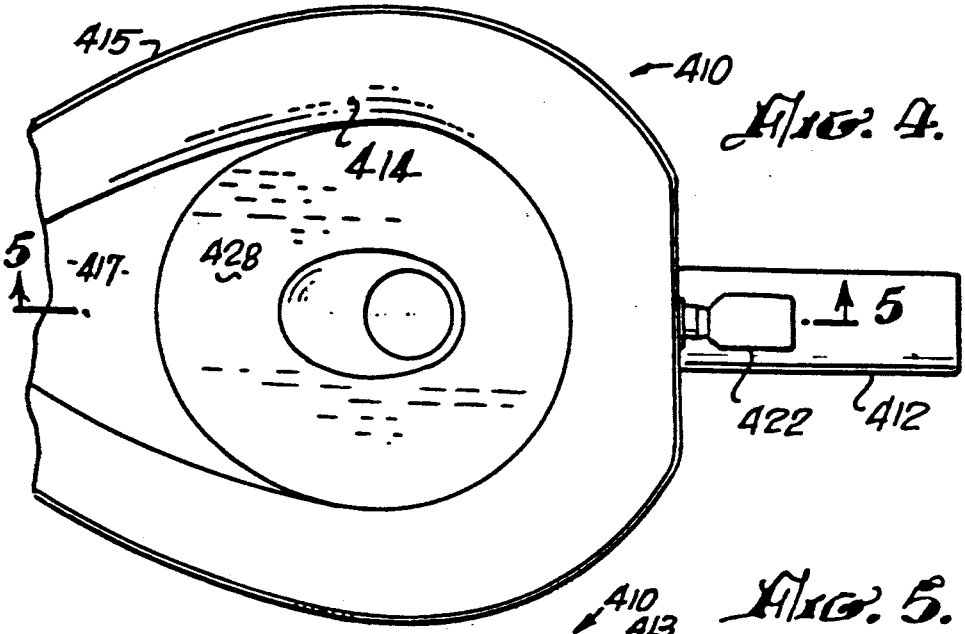
FIG. 4 is a plan view of a alternate embodiment of the toilet fixture of FIG. 1.
Figure 5:
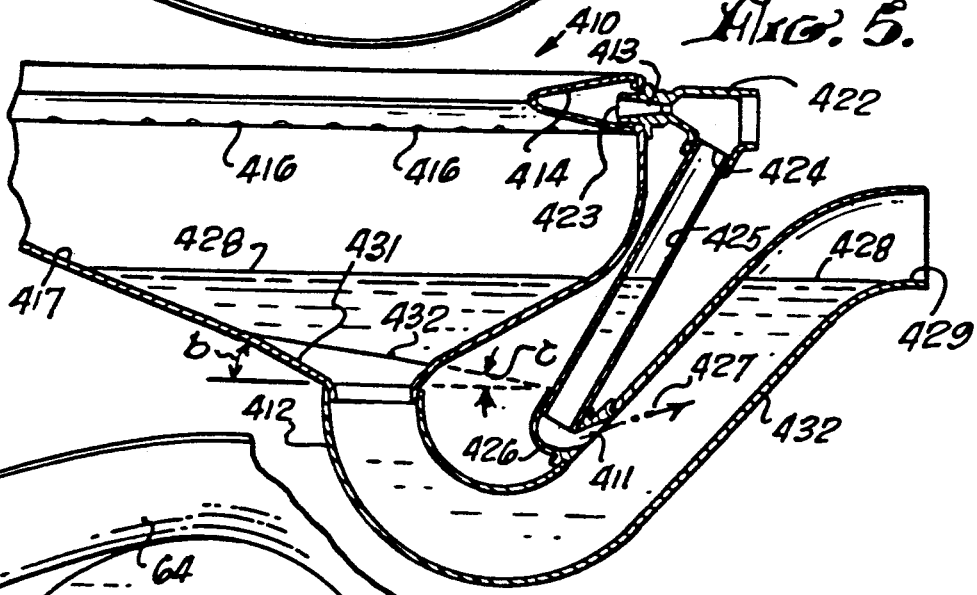
FIG. 5 is a cross-sectional view taken along line 5—5 of FIG. 4.

An alternate configuration of the bowl of FIGS. 1 through 3 is shown in FIGS. 4 and 5 and indicated by reference character 410. The reference characters in FIGS. 4 and 5 are like the reference characters in FIGS. 1, 2 and 3 except that 400 has been added to each number. The significant difference between the configuration of FIGS. 4 and 5 from that in FIGS. 1 through 3 is in the generally frusto-conical outlet ring 431. This ring has an upper terminus at 432 which is at an angle "c" from the horizontal. Thus, the frusto-conical cone is tilted, and the shallowest portion has an angle "b" with respect to the horizontal. Angle "b" is approximately 30°. It is believed that the tilting of this area reduces the tendency of the water in the bowl 417 to form a whirlpool.

Figure 6:
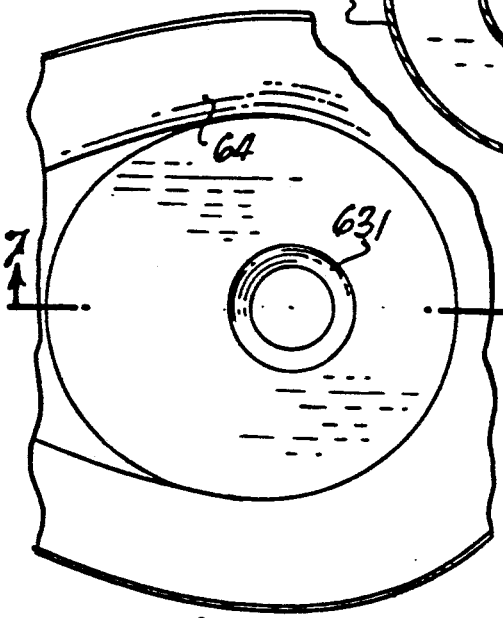
FIG. 6 is a plan view of a portion of the bowl of an alternate configuration of the toilet fixture of FIG. 1.
Figure 7:
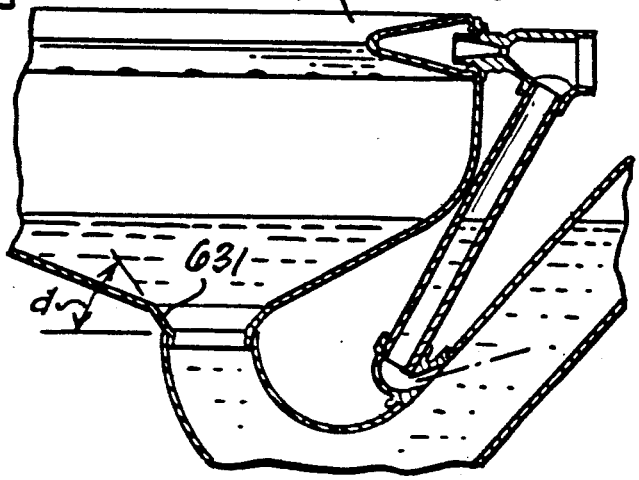
FIG. 7 is a cross-sectional view taken along line 7—7 of FIG. 6.

A still different version is shown in FIGS. 6 and 7 where the reference characters are the same in FIGS. 1 through 3 except 600 has been added to each number. The frusto-conical portion 631 has an angle "d" which is approximately 44° with respect to the horizontal.

The frusto-conical portion, of course, can be a smooth curve, but it should extend away from the diameter of the trap 12 at least one inch so that the water will flow out of the bowl with a minimum of turbulence.

It is believed that this development will substantially reduce water usage in institutions without sacrificing flushing efficiency. While the term "frusto-conical" has been used herein, it is intended that this term include slightly curved surfaces as would result typically from the making of a unit from clay.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved blow out toilet of the type having a toilet bowl, a trap affixed to the base of the bowl and leading downwardly, then curving upwardly to a straight portion at an angle of about 45 and then curving to approximately a horizontal orientation, which trap permits water to fill the bowl to a predetermined level, a rinse water outlet ring near the top of the interior of the bowl, said rinse water outlet ring having rinse water outlet openings, a rinse water nozzle including an orifice with its outlet directed into the rinse water outlet ring, a flush water nozzle including an orifice positioned in the trap below the predetermined water level and aimed rearwardly therein and a flush valve and piping providing a predetermined volume of water to be less than 1.6 gallons simultaneously to said nozzles when opened, wherein the improvement comprises:

a shallow angled toilet bowl base smoothly shaped that no more than about 0.66 gallon of water is held in the bowl and trap while providing an area of water coverage of at least about 10"×12";

a generally frusto-conically shaped ring at the base of the shallow angled toilet bowl providing a transition between the bowl and the trap;

a rinse water nozzle orifice between 0.21 and 0.26 inch in diameter;

a flush water nozzle orifice between 0.21 and 0.26 inch in diameter, said flush water orifice being mounted in the top of the trap at the beginning of the straight portion thereof.

2. The improved blow out toilet of claim 1 wherein the shallow angled toilet bowl base is generally frusto-conical in shape and has an angle of between about 20° and 35° with respect to the horizontal.

3. The improved blow out toilet of claim 1 wherein nozzle orifice size of the rinse water nozzle is about the same as the nozzle orifice size of the flush water nozzle.

4. The improved blow out toilet of claim 3 wherein said nozzle orifice size is about 0.25 inch.

5. An improved blow out toilet of the type having a toilet bowl, a trap affixed to the base of the bowl and leading downwardly, then curving upwardly to a straight portion at an angle of about 45 and then curving to a slight downward angle, which trap permits water to fill the bowl to a predetermined level, a rinse water outlet ring near the top of the interior of the bowl, said rinse water outlet ring having rinse water outlet openings, a rinse water nozzle including an orifice with its outlet directed into the rinse water outlet ring, a flush water nozzle including an orifice positioned in the trap below the predetermined water level and aimed rearwardly therein and a flush valve and piping providing a predetermined volume of water simultaneously to said nozzles when opened, wherein the improvement comprises:

a shallow, generally frusto-conically shaped toilet bowl base having an angle between about 20 and 35 with respect to the horizontal and placed with respect to the trap so that no more than about 0.66 gallon of water is held in the bowl and trap;

a smoothly shaped transition ring at the base of the shallow angled toilet bowl providing a transition between the bowl and the trap;

a rinse water nozzle orifice between 0.21 and 0.26 inch in diameter; and a flush water nozzle orifice between 0.21 and 0.26 inch in diameter, said flush water orifice being mounted in the top of the trap at the beginning of the straight portion thereof.

6. The improved blow out toilet of claim 5 wherein both of said nozzle orifices are about 0.250 inch in diameter.

7. The improved blow out toilet of claim 5 wherein said smoothly shaped transition ring is generally frusto-conical and has an angle between about 20° and 60° and extends away from the trap, at least at one point, a distance of at least one inch.

8. The improved blow out toilet of claim 5 wherein said smoothly shaped transition ring is a tilted, generally frusto-conical ring having the upper edge thereof lying in a plane which is at an angle of between about five and 15° from the horizontal.

* * * * *